US012377948B1

(12) United States Patent
Mabru

(10) Patent No.: US 12,377,948 B1
(45) Date of Patent: Aug. 5, 2025

(54) T-TOP MOUNTED MARINE AIR CONDITIONING UNIT AND ENCLOSURE

(71) Applicant: Alain Mabru, Dania Beach, FL (US)

(72) Inventor: Alain Mabru, Dania Beach, FL (US)

( * ) Notice: Subject to any disclaimer, the term of this patent is extended or adjusted under 35 U.S.C. 154(b) by 382 days.

(21) Appl. No.: 17/858,721

(22) Filed: Jul. 6, 2022

Related U.S. Application Data

(60) Provisional application No. 63/218,665, filed on Jul. 6, 2021.

(51) Int. Cl.
*B63J 2/02* (2006.01)
*B63J 2/12* (2006.01)

(52) U.S. Cl.
CPC .. *B63J 2/02* (2013.01); *B63J 2/12* (2013.01)

(58) Field of Classification Search
CPC ..... B63J 2/02; B63J 2/12; B60H 2001/00235; B60H 1/245; B63B 2017/026
See application file for complete search history.

(56) References Cited

U.S. PATENT DOCUMENTS

| | | | | |
|---|---|---|---|---|
| RE19,534 E * | 4/1935 | Hull | F24F 5/001 62/279 |
| 2,737,788 A | 3/1956 | Buttner | |
| 3,102,397 A | 9/1963 | Trucchi | |
| 3,111,013 A | 11/1963 | Ammons | |
| 4,217,764 A | 8/1980 | Armbruster | |
| 4,608,834 A | 9/1986 | Rummel | |
| 4,641,502 A * | 2/1987 | Aldrich | B60H 1/00378 62/429 |
| 4,967,569 A | 11/1990 | Machen et al. | |
| 5,848,536 A | 12/1998 | Dodge et al. | |
| 6,453,678 B1 | 9/2002 | Sundhar | |
| 6,701,733 B2 | 3/2004 | Brunner | |
| 7,246,502 B2 | 7/2007 | Hammonds et al. | |
| 7,735,330 B2 | 6/2010 | Richter et al. | |
| 8,056,351 B2 | 11/2011 | Marciano et al. | |
| 8,256,239 B2 | 9/2012 | Buzzi | |
| 2002/0026797 A1 | 3/2002 | Sundhar | |
| 2008/0202138 A1 | 8/2008 | Pabisz et al. | |
| 2010/0251739 A1 | 10/2010 | Mabru | |

(Continued)

*Primary Examiner* — Edelmira Bosques
*Assistant Examiner* — Brett Peterson Mallon
(74) *Attorney, Agent, or Firm* — Mark D. Bowen, Esq.; Malin Haley DiMaggio & Bowen, P.A.

(57) ABSTRACT

A marine A/C system adapted for rooftop installation on a marine T-top on a marine vessel includes a package water-source heat pump having a DC powered refrigerant compressor, a corrosion resistant evaporator coil, and a water-cooled condenser. The package unit is housed within a fully enclosed protective structural weatherproof enclosure or dome, which may be formed in a disc shape resembling a high-end radar dome. Condenser water supply and return lines are concealed within structural tubing forming the T-top support frame thereby rendering the installation non-obvious. Condensate generated by evaporator coil collects in a drain pan and is removed by a suction fitting installed in the drain which is connected to a venturi fitting disposed in the condenser water line such that condensate is drawn from the dain pan and injected into the condenser water line. By injecting the condensate into the condenser water line the number of lines running to and/or from the T-top mounted package unit and in need of concealment is reduced.

8 Claims, 6 Drawing Sheets

(56) References Cited

U.S. PATENT DOCUMENTS

| | | | | |
|---|---|---|---|---|
| 2015/0101360 | A1 | 4/2015 | Leblanc et al. | |
| 2020/0406720 | A1* | 12/2020 | Hotta | B60H 1/32331 |
| 2021/0188414 | A1* | 6/2021 | Mills | B63B 19/04 |
| 2022/0126973 | A1* | 4/2022 | Ripoll | F25B 13/00 |

* cited by examiner

T-TOP MOUNTED MARINE AIR CONDITIONING UNIT AND ENCLOSURE

CROSS REFERENCE TO RELATED APPLICATIONS

This application claims the benefit of provisional U.S. Patent Application Ser. No. 63/218,665, filed on Jul. 6, 2021.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise retains all copyright and all other rights reserved.

BACKGROUND OF THE INVENTION

1. Field of the Invention

The present invention relates generally to marine air conditioning systems, and more particularly to roof mounted unit specifically configured for providing comfort cooling and heating for occupants of an open cockpit.

2. Description of Related Art

The use of air conditioning ("A/C") systems to provide comfort cooling and heating is well known. Air conditioning systems operate using a vapor-compression refrigeration cycle to transfer thermal heat from one space to another. Heat pump air conditioning systems operate using a reverse refrigeration cycle wherein they are capable of operating in both cooling and heating modes. When operating in a "cooling mode", the heat pump absorbs heat from a conditioned space and transfers the heat to a warmer space. Conversely, when operating in a "heating mode", a heat pump will absorb heat from a cool space and transfer the heat to a warmer space. Air source heat pumps condition a space for comfort cooling/heating by transferring heat to/from ambient outdoor air, while water source heat pumps condition a space for comfort cooling/heating by transferring heat to/from a body of water. Water source heat pumps are generally more efficient that air source heat pumps as the efficiency of heat transfer using an air-to-refrigerant heat exchanger is significantly less than the efficiency of heat transfer using a water-to-refrigerant heat exchanger.

Air conditioning systems are commonly used to provide comfort cooling and heating in virtually any occupied space. The design and installation of air conditioning systems for marine applications, particularly smaller boats, has been difficult due to the lack of available space on such vessels and coupled with the desire for quite operation. Accordingly, the installation of air conditioning systems in marine vessels is wrought with difficulties and limitations that are unique to such applications.

As a result of these limitations, the background art reveals several attempts to provide comfort cooling for marine vessels. For example, U.S. Pat. No. 4,967,569, issued to Machen, discloses a portable through-hatch package air conditioning unit designed to be removably mounted on an open marine hatch. U.S. Pat. No. 3,102,397, issued to Trucchi, discloses the use of an air source split-system to cool a ship's cabin wherein the evaporator and blower are housed in a cylindrical housing sized for insertion within a scuttle frame opening. U.S. Pat. No. 5,848,536 issued to Dodge, discloses a self-contained marine air conditioner that is mounted within a marine vessel. In Patent Application Publication No. 2010/0251739, the present inventor disclosed a compact marine air conditioning unit having an axial supply fan and designed for installation in the interior of a marine vessel.

Additional challenges, however, are presented when attempting to design and install air conditioning systems on small boats, particularly "center console" and/or "open fisherman" type craft and the like due to severe space constraints. Generally speaking, a "center console" vessel is a boat having an open deck layout with the steering/control console situated in the middle of the deck with space on either side. Center console boats are often equipped with a T-top for providing a small amount of shade. A "T-top" is a metal frame mounted to the deck of a center console boat supporting a hard or soft top roof to provide standing height shade. In addition, other boats with generally open air cockpit areas have roof structures to provide standing height shade.

Providing air conditioning for center console boats and other open air cockpit vessels is a long-standing problem that has yet to be adequately solved. As noted above, boats with open cockpits are typically smaller vessels that lack space to accommodate air conditioning units. As a result of this limitation, attempts have been made to install air-cooled roof mounted air conditioning units on marine vessels. Those attempts, however, have largely proven unsuccessful since rooftop marine air conditioning units having air cooled condensers are exposed to sea spray thus leading to corrosion and rapid failure. Attempts to provide water-cooled units have also proven unsuccessful due to the inability to adequately route condenser water supply and return lines concealed from view.

The background art has failed to disclose an effective solution for providing marine air conditioning for center console and outfitted with T-tops, as well as other open air cockpit vessels. Since T-tops are elevated above console and supported sometimes exclusively by aluminum tubing, running condenser cooling water and electrical power to a T-top mounted air conditioner is problematic. In addition, because such units will typically operate on 100% humid outside air in such open cockpit applications, large quantities of condensate are produced. Without an effective condensate drain solution, condensate will simply spill off of the T-top and into the boat or onto the occupants.

Accordingly, there exists a need for advancements in the field of marine air conditioning units. More particularly, there exists a need for a marine air conditioning system that can be installed on top of a T-top super structure and protected from the harsh marine environments by a fully enclosed dome, and wherein all the condenser cooling water, condensate piping, and electrical power cables are fully concealed.

BRIEF SUMMARY OF THE INVENTION

The present invention overcomes the limitations and disadvantages present in the art by providing a water-source package marine A/C system adapted for rooftop installation on a marine T-top (or other rigid shade structure) on a marine vessel. Openings formed in the T-top provide a supply air opening to permit the flow of supply air from the rooftop mounted unit to the cockpit area disposed below the T-top, and a return air opening for the drawing air from the cockpit area into the unit. The A/C system preferably comprises a package water-source heat pump having a DC powered refrigerant compressor, a corrosion resistant evaporator coil, and a corrosion resistant water-cooled condenser. The package unit is housed within a fully enclosed protective structural weatherproof enclosure or dome, which may be formed in a disc shape resembling a high-end radar dome found on larger vessels. A pump draws condenser water from the body of water in which the vessel is operating via a thru-hull fitting thereby maximizing unit efficiency through the use of a condenser in the form of a refrigerant-to-water heat exchanger. Condenser water supply and return lines are concealed within structural tubing forming the T-top support frame thereby rendering the installation clean and non-obvious. Condensate generated by evaporator coil collects in a drain pan and is removed by a suction fitting installed in the condensate drain pan which is connected to a venturi fitting disposed in the condenser water line such that condensate is drawn from the drain pan and injected into the condenser water line. By injecting the condensate into the condenser water line the number of lines running to and/or from the T-top mounted package unit and in need of concealment is significantly reduced.

It is thus an object of the present invention to provide advancements in the field of marine air conditioning units.

It is another object of the present invention to provide a package water-source heat pump adapted for mounting on a T-top roof of a marine vessel.

Still another object of the present invention is to provide a package water-source heat pump for rooftop installation on the T-top of a marine vessel with the condenser water supply and return lines concealed within the tubular T-top support frame.

Yet another object of the present invention it to provide a package water-source heat pump for rooftop installation on the T-top of a marine vessel adapted with a condensate management system wherein the venturi effect is used to suction condensate from the condensate drain pan into the condenser water line.

Still another object of the present invention is to provide a T-top mounted package air conditioning unit for marine vessel wherein the unit is protected from the elements within a fully enclosed structural weatherproof enclosure.

It is another object of the present invention to provide such an enclosure in a disk shape to mimic the external appearance of a radar dome.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

In describing this invention, the word "connected" is used. By "connected" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another. By adjacent to a structure is meant that the location is near the identified structure.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
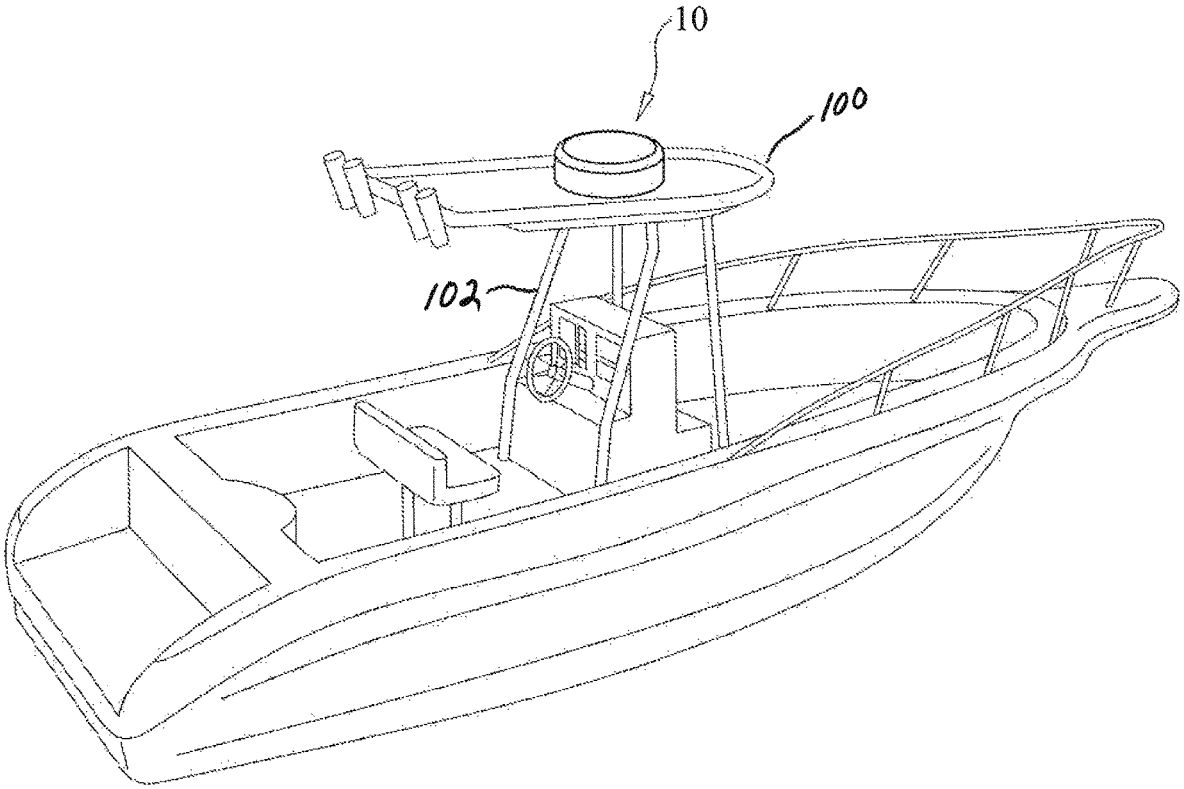
FIG. 1 illustrates a marine vessel adapted with a T-top mounted air conditioning system in accordance with the present invention.

Turning now to the drawings, FIG. 1-6 illustrate a T-top mounted marine air conditioning system, generally referenced as 10, in accordance with the present invention. FIG. 1 illustrates a marine vessel having a T-top 100 disposed in an elevated position by tubular frame members 102. A marine air conditioning system in accordance with the present invention, generally referenced as 10, is mounted on the upper surface of the T-top. A significant aspect of the present invention involves an installation of the marine air conditioning system 10 within a fully enclosed dome that resembles a radar dome without any exposed piping or wiring.

Figure 2:
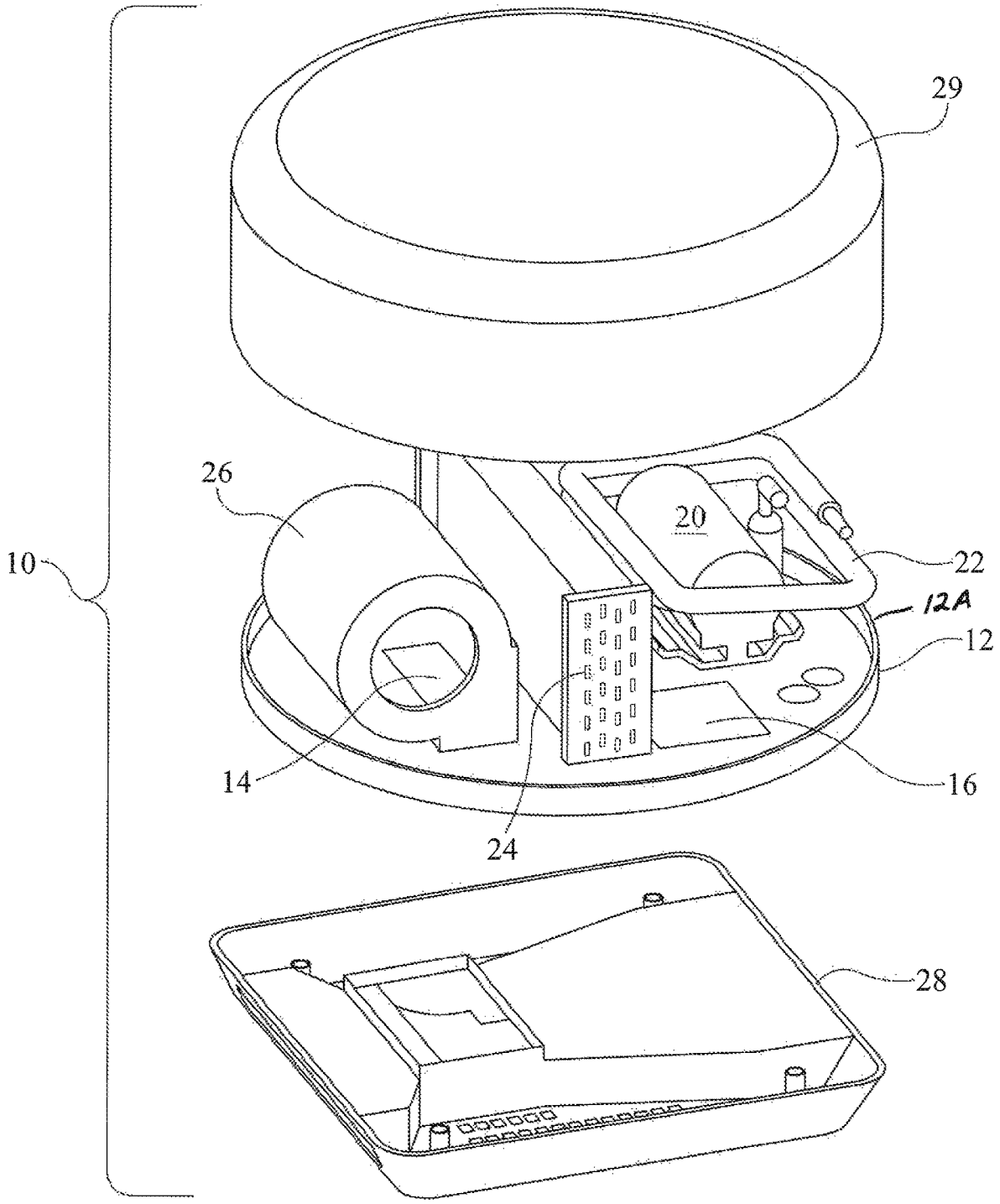
FIG. 2 is an exploded perspective illustration of a T-top mountable marine air conditioning system of the present invention.
Figure 3:
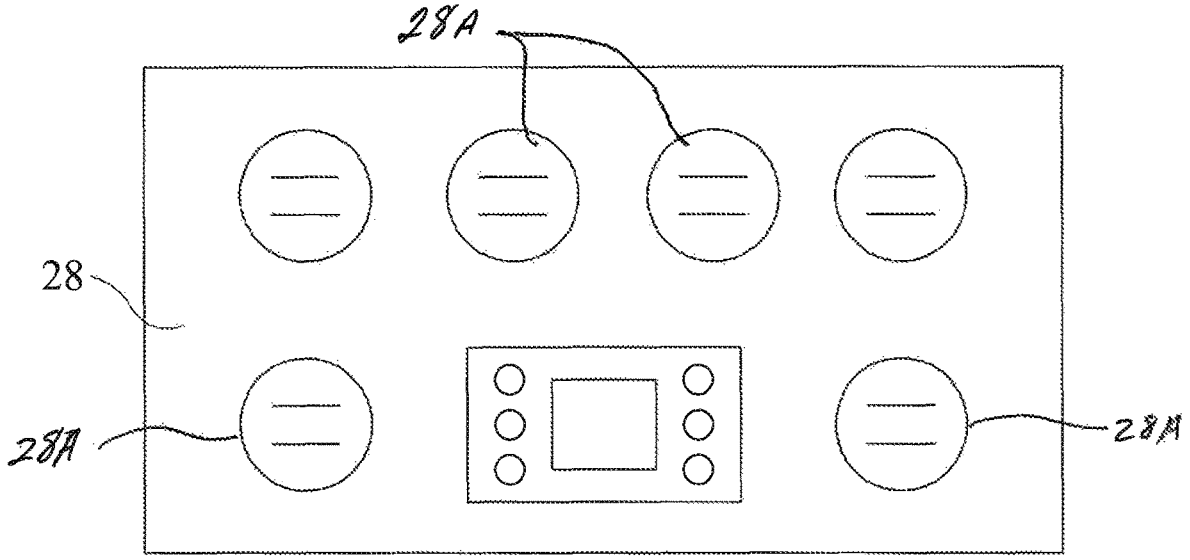
FIG. 3 illustrates a combined diffuser and control panel for use with the T-top mounted marine air condition system of the present invention.

FIG. 2 depicts an exploded view of a self-contained water-source package marine air conditioning unit, generally referenced as 10, in accordance with the present invention. The present invention is specifically designed for rooftop installation on a marine T-top (or other rigid shade structure), referenced as 100, on a marine vessel with an open cockpit or substantially open air cockpit configuration to provide conditioned air directly to the cockpit occupants disposed below the T-top. T-top 100 is supported by tubular support frame members 102. Marine air conditioner 10 is preferably configured as a 12 VDC powered package water-source heat pump that uses water from the body of water upon which the marine vessel is operating as condenser water that circulates through the condenser. Marine air conditioning unit 10 is preferably manufactured in various sizes and tonnage capacities, including ½ ton (e.g. 6,000 BtuH), 1.0 ton, 1½ ton, 2 ton, etc.

Marine air conditioning unit 10 is mounted within a housing having a base 12 and a dome or cover 29 removably connected to the base. Base 12 provides a structure that may be mouted to the upper surface of a T-top and further provides a mounting surface upon which air conditioning components may be mounted. Base 12 is preferably fabricated from a corrosion resistant material, such as stainless steel, fiberglass, carbon fiber composite, molded plastic, or any other suitable material. In a preferred embodiment base 12 is generally circular for reasons more fully discussed herein. Base 12 has an upwardly projecting peripheral lip 12A and defines a supply air opening 14 to allow for the outflow of conditioned air and a return air opening 16 to allow for the inflow of return air. Base 12 is adapted for secured connection to the top of a marine vessel T-top using known connection methods and apparatus, such as mechanical fasteners.

As noted above, base 12 provides a mounting structure for refrigeration, air handling, and accessory components. As shown in FIG. 1, base 12 has mounted thereon a DC powered refrigerant compressor 20 in fluid communication with a condenser 22, preferably comprising a refrigerant-to-water heat exchanger, a refrigerant-to-air evaporator coil 24 in fluid communication with condenser 22, and a supply fan 26. A combination control and diffuser panel 28 is mounted to the underside of the vessel T-top below base 12. Control and diffuser panel 28 includes user adjustable controls (i.e. on/off, cooling/heating mode, temperature settings, fan speed) as well as supply air diffusers which are adjustable for both direction and volume of air flow. A dome 29 is adapted for mating engagement with base 12. When installed in mating sealing engagement with base 12, dome 29 provides a fully enclosed protective structural weatherproof protective shell that isolates the internal components from corrosive sea spray. A significant aspect of the present invention involves providing dome 29 formed in a disc shape that resembles a high-end radar dome found on larger and vessels. Dome 29 is preferably thermally insulated and functions to substantially enclose and protect from the elements compressor 20, condenser 22, evaporator 24, supply fan 26, and various electrical and control components, such as capacitors, thermal expansion valves, high and low pressure switches, etc.

As noted above, refrigerant compressor 20 comprises a DC powered unit using hydrofluorocarbon HFC-134a (R-134a). Compressor 20 preferably comprises a scroll-type refrigerant compressor of the type commonly used in vapor compression refrigeration systems, however, any suitable compressor is considered within the scope of the present invention. As discussed above, a significant issue facing the installation of air conditioning units on smaller vessels fitted with T-top cockpit shade structures involves the inability to conceal power cables and water conduits routed to the A/C unit from various service locations on the boat. The present invention addresses this issue by routing DC power from the DC power source up through the otherwise hollow interior of one or more of the tubular T-top support frame members 102.

Figure 4:
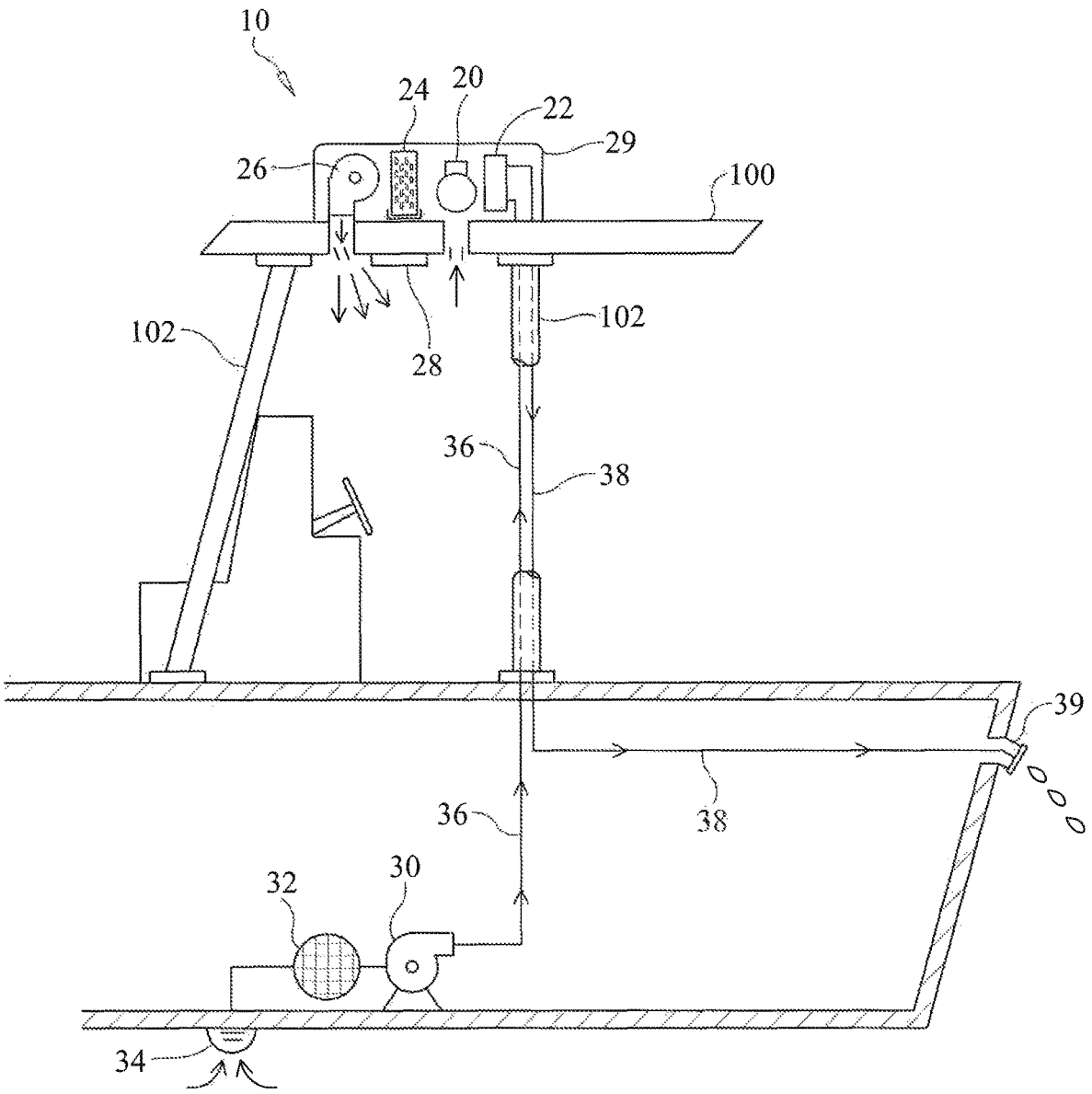
FIG. 4 is a partial side sectional schematic view of a marine vessel adapted with a T-top mounted air conditioning system in accordance with the present invention.
Figure 5:
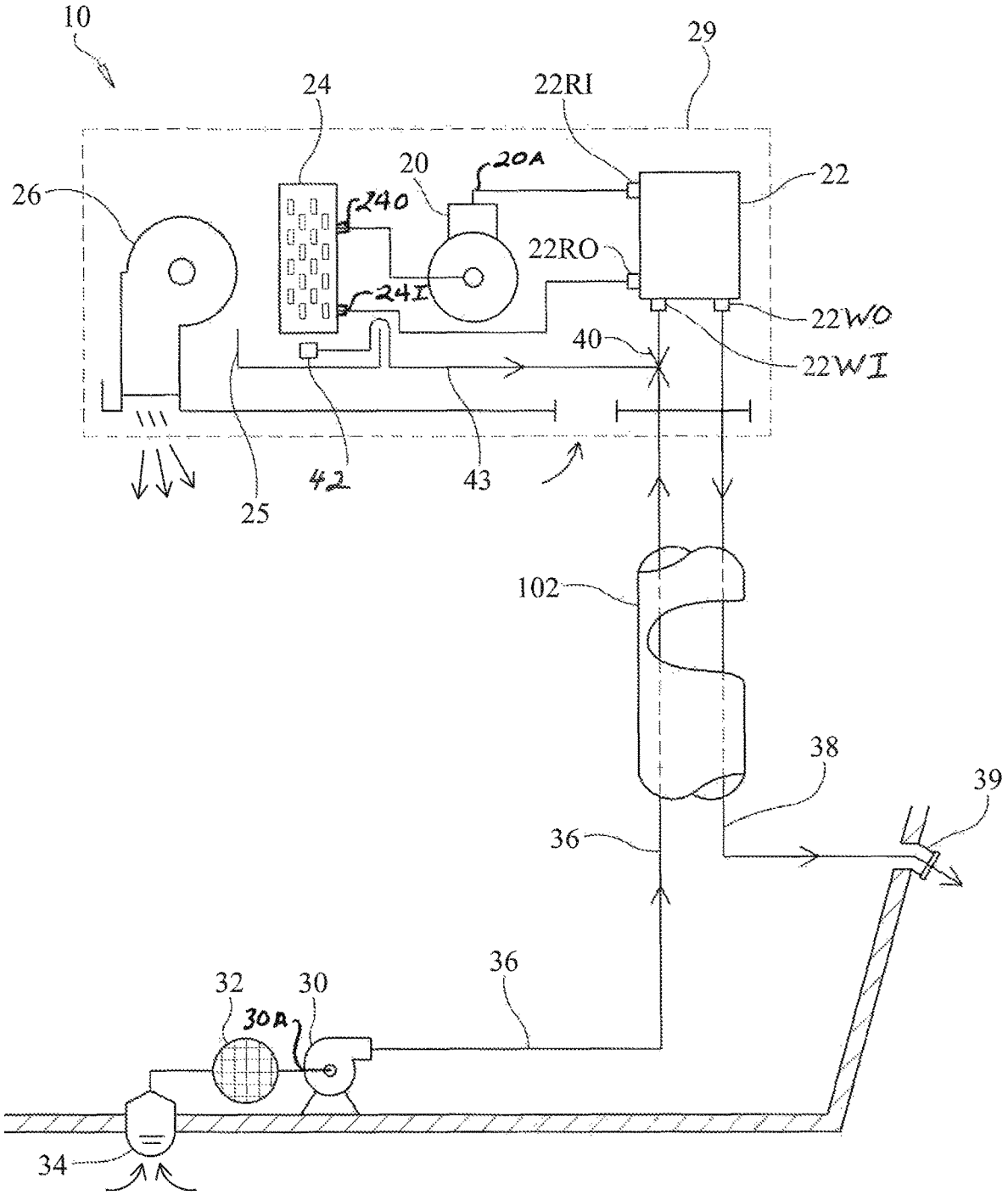
FIG. 5 is a another schematic illustration of the T-top mounted air conditioning system in accordance with the present invention.

FIGS. 4 and 5 provide more detailed illustrations of the air conditioning components. Refrigerant compressor 20 has an outlet 20A in fluid communication with refrigerant condenser 22. Condenser 22 preferably comprises a generally tubular co-axial water-to-refrigerant heat exchanger having a refrigerant inlet and outlet, referenced as 22RI and 22RO respectively, and a condenser water inlet and outlet, referenced as 22WI and 22WO respectively. Compressor outlet 20A is in fluid communication with condenser refrigerant inlet 22RI to receive compressed refrigerant gas that passes through condenser 22 experiencing a vapor to liquid phase change whereafter the liquid refrigerant exits condenser outlet 22RO. Condenser 22 further includes a condenser water inlet 22WI and a condenser water outlet 22WO. Condenser water inlet 22WI is in fluid communication with a condenser water pump 30 having an inlet 30A in fluid communication with a strainer 32 and thru-hull fitting 34 which projects through the vessel hull at a submerged location via condenser water supply line 36. Condenser water outlet 22WO has a condenser water return line 38 terminating at a thru-hull discharge fitting 39, which is preferably disposed above the waterline. As discussed above, the condenser water supply and return lines are routed up through the otherwise hollow interior of one or more of the tubular T-top support frame members 102 thereby concealing those lines from view.

Evaporator coil 24 preferably comprises a corrosion resistant copper tube and copper fin construction as used in direct expansion vapor compression refrigeration cycle units, however, evaporator coil 24 may be any suitable configuration, e.g. flat, L-shaped, A-shaped, etc. Condenser 22 has its refrigerant outlet 22RO in fluid communication with an inlet 241 evaporator coil 24. Refrigerant exits evaporator coil 24 in a gas state via evaporator coil outlet 240 and returns to compressor 20.

A condensate drain pan 25 is mounted below evaporator coil 24. Supply fan 26 preferably comprises a centrifugal blower having an inlet disposed on a leaving air side of evaporator coil 24 and an outlet directed generally downward through supply air opening 14 in base 12. Supply air opening 14 is aligned with a corresponding opening in the vessel T-top whereby supply air passes from supply fan 26 through the base supply air opening 14 and the corresponding opening it the vessel T-top, and finally into control and diffuser panel 28 whereby the supply air exits through one or more diffusers 28A. The inlet of supply fan 26 draws air from the cockpit area back up through the T-top via return air opening formed therein and disposed in alignment with the return air opening 16 in base 12 which is located on the entering air side of refrigerant-to-air evaporator coil 24.

Figure 6:
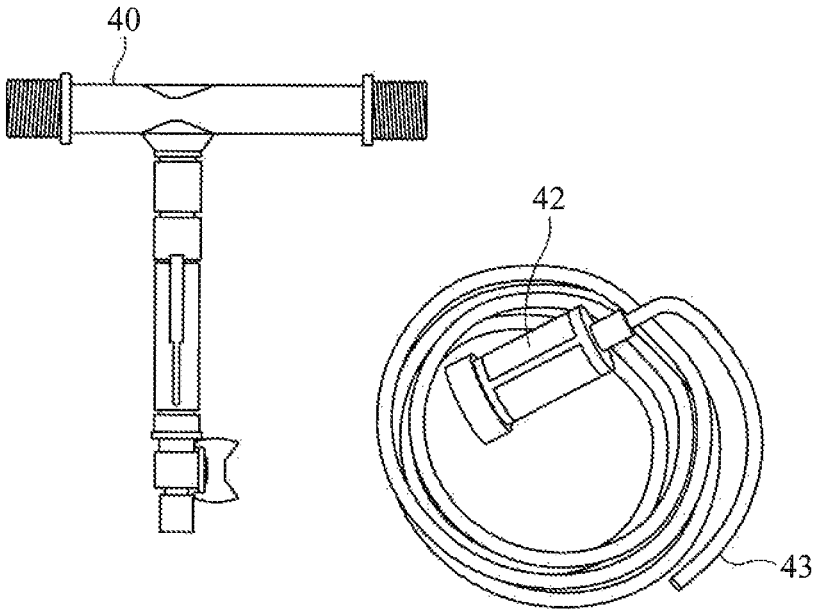
FIG. 6 illustrates an embodiment of a condensate management Ventrui apparatus for use with the present invention.

A further significant aspect of the present invention involves condensate management. As illustrated in FIGS. 5 and 6, a Venturi fitting 40 is disposed in the condenser water supply line 36 and in fluid communication with a suction tip 42 located in condensate drain pan 25 via a flexible tube 43. Condenser water flowing through Venturi fitting 40 creates suction at tip 42 that draws water from drain pan 25 and causes the condensate to flow into and mix with the condenser water flowing through supply line 36. Because the condensate forms on the evaporator coil it is chilled and thus, upon mixing with the condenser supply water, lowers the temperature of the water entering condenser 22 thereby increasing the temperature difference (i.e. $\Delta T$) between the incoming condenser water and the hot gas refrigerant. The increased temperature difference results in improved heat transfer efficiency. Collected condensate is discharged from the vessel along with the condenser water via return line 38 and discharge fitting 39. The condensate management system of the present invention maintains the condensate drain pan substantially dry thereby preventing condensate from sloshing about or leaking on to the upper surface of the T-top, while improving heat transfer efficiency at the condenser.

It should be noted that all refrigerant and condenser water lines illustrated are shown to simply explanation of the present invention and the illustrations are not intended to place limitations thereon. As should be apparent, various advantages of the present invention may be realized independently. In addition, features disclosed herein may be used with straight cool as well as heat pump systems.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A marine air conditioning system for installation on a marine vessel having a T-Top standing shade structure supported by tubular frame members, said system comprising:

a housing mounted on top of the T-top;

a water source package air conditioning unit disposed within said housing;

said air conditioning unit including a DC powered compressor, a refrigerant-to-water condenser, a refrigerant-to-air evaporator coil, and a supply fan;

said supply fan having an outlet configured to discharge conditioned air below the T-top;

a condensate drain pan disposed below said evaporator coil;

said condenser having a condenser water inlet and a condenser water outlet;

a condenser water pump having an inlet in communication with a thru-hull fitting and an outlet in fluid communication with said condenser water inlet via a condenser water supply line, said condenser water outlet in fluid communication with a water discharge fitting via a condenser water return line;

said condenser water supply line and said condenser water return line concealed within at least one T-top tubular frame support member; and a combination control and diffuser panel mounted to the underside of the vessel T-top including user adjustable controls.

2. The marine air conditioning system of claim 1 further including a Venturi fitting in fluid communication with said condenser water supply line, said Venturi fitting having a suction inlet in fluid communication with a suction tip located in said condensate drain pan, whereby condensate collected in the drain pan is suctioned into said condenser water supply line.

3. A marine air conditioning system for installation on a marine vessel having a T-Top standing shade structure supported by tubular frame members, said system comprising:

a housing having a base mounted on top of the T-top and a dome adapted for sealing mating engagement with said base to provide a fully enclosed weatherproof protective shell that isolates internal components from corrosive sea spray;

said base defining a supply air opening and a return air opening;

an air conditioning unit disposed within said housing, said air conditioning unit including a DC powered compressor, an evaporator coil, a refrigerant-to-water condenser, and a supply fan;

a condensate drain pan disposed below said evaporator coil;

said supply fan having an outlet configured to discharge conditioned air below the T-top through said supply air opening;

said condenser having a condenser water inlet and a condenser water outlet;

a condenser water pump having an inlet in communication with a thru-hull fitting and an outlet in fluid communication with said condenser water inlet via a condenser water supply line, said condenser water outlet in fluid communication with a water discharge fitting via a condenser water return line;

a Venturi fitting disposed in said condenser water supply line, said Venturi fitting having a suction inlet in fluid communication with a suction tip located in said condensate drain pan, whereby condensate collected in the drain pan is suctioned into said condenser water supply line; and at least portions of said condenser water supply line, said condenser water return line, and each being concealed within the T-top tubular frame support members.

4. The marine air conditioning unit of claim 3 further including a Venturi fitting disposed in said condenser water supply line, said Venturi fitting having a suction inlet in fluid communication with a suction tip located in said condensate drain pan, whereby condensate collected in the drain pan is suctioned into said condenser water supply line.

5. The marine air conditioning unit of claim 3 wherein said dome is disc-shaped.

6. In a marine vessel having a hull, a cockpit, and a shade structure disposed above the cockpit, with the shade structure including a roof supported by at least one tubular support frame member, wherein the marine vessel comprises:

a housing mounted on top of the roof, said housing having a base including a condensate pan, and defining a supply air opening and a return air opening, and a dome in removable engagement with said base;

said dome forming a fully enclosed protective shell that isolates said housing interior from corrosive sea spray;

an air conditioning unit disposed within said housing, said air conditioning unit including a DC powered compressor, an evaporator coil, a refrigerant-to-water condenser, and a supply fan;

said supply fan configured to discharge conditioned supply air through said supply air opening below the roof of the cockpit shade structure;

said refrigerant-to-water condenser having a water inlet and a water outlet;

said refrigerant-to-water condenser inlet in fluid communication with a condenser water supply line, and said refrigerant-to-water condenser outlet in fluid communication with a condenser water return line configured to discharge condenser water from the vessel;

a condensate drain line having an inlet in fluid communication with said condensate drain pan and an outlet in communication with said condenser water supply line, whereby condensate is injected into the condenser water supply from said drain pan;

at least a portion of said condenser water supply line and said condenser water return line installed within and concealed by the at least one tubular support frame member.

7. The marine vessel of claim 6 further including a Venturi fitting disposed in said condenser water supply line, said Venturi fitting having a suction inlet in fluid communication with a suction tip located in said condensate drain pan, whereby condensate collected in the drain pan is suctioned into said condenser water supply line.

8. The marine vessel of claim 6 further including a combination control and diffuser panel mounted to the underside of the vessel shade structure.

* * * * *